US006073468A

United States Patent [19]

Wallace

[11] Patent Number: 6,073,468

[45] Date of Patent: Jun. 13, 2000

[54] LOW TORQUE KNIT CONSTRUCTION

[75] Inventor: Jerry E. Wallace, Statesville, N.C.

[73] Assignee: Burlington Industries, Inc., Greensboro, N.C.

[21] Appl. No.: 09/053,729

[22] Filed: Apr. 2, 1998

[51] Int. Cl.[7] ..... D04B 7/26

[52] U.S. Cl. ..... 66/202; 66/169 R

[58] Field of Search ..... 66/169 R, 201, 66/202, 200, 170, 198

[56] References Cited

U.S. PATENT DOCUMENTS

| | | | |
|---|---|---|---|
| 2,738,566 | 3/1956 | Scott, Jr. | 66/200 |
| 3,178,911 | 4/1965 | Faust . | |
| 3,299,486 | 1/1967 | Meyers et al. | 66/169 R |
| 3,742,732 | 7/1973 | Plath | 66/42 |
| 3,878,928 | 4/1975 | Usdan . | |
| 3,936,996 | 2/1976 | Schiffer . | |
| 4,355,499 | 10/1982 | Takai | 66/200 |
| 4,523,428 | 6/1985 | Negishi et al. | 57/208 |

FOREIGN PATENT DOCUMENTS

| | | |
|---|---|---|
| 7311311 | 12/1966 | Japan . |
| 1183539 | 1/1988 | Japan . |
| 1266135 | 1/1968 | United Kingdom . |
| 1381046 | 2/1972 | United Kingdom . |
| WO 9419518 | 2/1993 | WIPO . |

OTHER PUBLICATIONS

"Find Twists & Turns that Reduce Spirality", *Daily News Record*, Jul. 6, 1988, p. 6.

"Knit Fabrics and the Reduction of Torque", Abstract of report by Cotton Inc., 1992.

Kimmel et al, "Selected Properties of Predominantly Cotton Staple—Core Knitted Fabrics", *Technical Research Journal*, Oct., 1995, pp. 587–592.

Park et al, "Spirality of Weft–Knitted Fabrics—Effect of Yarn Properties and Fabric Parameters", Federation of Asian Professional Associations for 1966, p. 27.

*Primary Examiner*—Danny Worrell

*Attorney, Agent, or Firm*—Nixon & Vanderhye P.C.

[57] ABSTRACT

A jacquard cotton construction fabric, and garment made from the fabric, are produced by spinning and Z-twisting a first at least primarily cotton yarn, spinning and S-twisting a second at least primarily cotton yarn, dyeing the yarn a first color, dyeing the second yarn a second color different from the first color, and knitting a jacquard construction fabric using a ratio of between 70:30 to 30:70 of the first and second yarns so that a fabric having a torque below 8% (preferably less than 5%, e.g. between about 0–2%) is produced. The yarns are preferably substantially 100% cotton, and there may be either an S- or Z-twisted third yarn dyed a third color so that a three color jacquard construction fabric is produced with the first, second and third yarns. The fabric, or garment produced from the fabric, has no discernible course by course slant effect, has a softer hand because a stiffening agent is not necessary to finish the fabric, and there are improvements in the finishing process as well as in the final garment.

20 Claims, 2 Drawing Sheets

LOW TORQUE KNIT CONSTRUCTION

BACKGROUND AND SUMMARY OF THE INVENTION

Excessive torque is a significant problem in circular knitted fabrics. "Torque" is when the wale line and the course line are not at a 90° angle after washing. In garments this effect is manifest by side seam movement as well. While excess torque can be a problem in most circular knitted fabrics, it is particularly significant for jacquard cotton construction fabrics. Garment manufacturers require that the torque be kept below 8%, but this can be a real problem in producing jacquard cotton construction fabrics.

A standard technique used by many fabric manufacturers to produce cotton jacquard construction fabrics is to use 100% Z-twisted ring spun yarn of substantially 100% cotton. It has been known, per se, to use Z-twist and S-twist yarns together to reduce torque, but is not normally employed because a non-smooth fabric appearance results; that is, in one course line the stitch slants to the left, and in the next course line the stitch slants to the right. For solid piece dyes or solid area dyes, this course by course slant effect essentially makes the construction unmarketable to any broad customer base at all. Also, current methods for making jacquard constructions that do not have the course by course slant effect problem are either inconsistent in being able to meet the less than 8% torque requirement (many batches have a torque of 10–13%), and/or results in weak fabrics, which of course means poor quality.

According to the present invention, it is possible to solve the course by course slant effect problem while consistently achieving a torque below 8%. This is accomplished, according to the invention, by using differently colored yarns in different courses. In practicing the invention, it is possible to produce fabrics that have very low torque values, on the order of 0–2%, while unexpectedly realizing numerous other advantages. For example, the fabrics and garments according to the invention have a much softer hand than is normal because little or no stiffening agent is used to finish the fabric to minimize curling (as is done in conventional constructions which minimize curling). The fabrics according to the invention lay very flat, and realize significant improvement in the finishing process for bow/bias/hook because the fabric is straight going to the finishing frame, and the torque does not affect the edge of the fabric for hook after slitting. Also, the garment formation process is simpler because the garment lays flatter during garment formation. Also, the garment lays flatter after washing because of little, if any, torque in the fabric.

According to one aspect of the present invention a method of making a jacquard construction fabric is provided, comprising the following steps: (a) Spinning and Z-twisting a first at least primarily cotton yarn. (b) Spinning and S-twisting a second at least primarily cotton yarn. (c) Dyeing the first yarn a first color. (d) Dyeing the second yarn a second color different than the first color. And (e) knitting a jacquard construction fabric using the first and second yarns in a ratio of about 30–70% Z-twist yarn to about 70–30% S-twist yarn, so that a fabric having a torque below 8%, and substantially no discernible course by course slant effect, is produced.

The method comprises the further steps of: spinning and either Z or S twisting a third at least primarily cotton yarn, and (g) dyeing the third yarn a third color, different than the first and second colors; and wherein step (e) is practiced by knitting a three color jacquard construction fabric using the first, second, and third yarns.

Steps (a) and (b) and (f) are preferably practiced by ring spinning, and producing substantially 100% cotton yarns having a yarn size for each yarn of between 8/1's to 40/1's cotton, and the sizes of the first and second yarns not differing by more than two sizes. There also typically are the additional steps of finishing the fabric (which is simpler and improved as described above, e.g. substantially without stiffener) and making the fabric into a garment (which is also simplified due to the lay-flat nature of the garment). The method steps are typically practiced to produce a fabric with a torque of less than 5%, e.g. between about 0–2%, and is practiced so that the colors are distinct enough so that there is substantially no discernible course by course slant effect in the resulting garment either.

According to another aspect of the present invention, a fabric is provided comprising the following components: First and second yarns providing a jacquard knit construction fabric, having a torque of less than 8% and substantially no discernible course by course slant effect. The first yarn comprising a first color Z-twisted at least primarily cotton yarn. The second yarn comprising a second color, different than the first yarn, S-twisted at least primarily cotton yarn; and the fabric having a ratio of about 30–70% Z-twist yarn to about 70–30% S-twist yarn. The fabric may be provided in combination with conventional stitching forming the fabric into a finished garment, and the fabric and resulting garment preferably have a torque of less than 5%, e.g. between about 0–2%. The yarns are preferably ring spun substantially 100% cotton yarns. The fabric may further comprise a third at least primarily cotton either S or Z-twisted yarn having a third color different from the first and second colors, the fabric jacquard knit construction comprising the first, second and third yarns.

According to another aspect of the present invention a fabric is provided comprising: First, second and third yarns in a jacquard knit construction fabric, the fabric having a torque of less than 5%. The first yarn comprising a Z-twisted substantially 100% cotton ring spun yarn. And the second and third yarns each comprising an S-twisted substantially 100% cotton ring spun yarn, or a combination of S- and Z-twisted yarns, and wherein the fabric has substantially no discernible course by course slant effect. Equivalent to this construction is one where the first yarn is S-twisted and the second and third yarns are Z-twisted. The fabric is preferably used in combination with stitching to form a finished garment, and the yarns typically comprise at least two different colors.

Under some circumstances it is possible to produce a fabric using even more than three different color yarns.

While the invention may be practiced so that at least about 30% of the yarns are of one twist (e.g. S-twist) with the other about 70% the other twist (e.g. Z-twist); the best performance is achieved when about 50% (e.g. 45–55%) of each type of yarn is provided. Typically, the size of the yarn is not a result effective variable, as long as the first and second yarns are of approximately the same size, so that they have comparable innate twist forces that can be exerted. However it is preferred that the yarns have a size between 8/1's to 40/1's (e.g. 18/1's to 28/1's) cotton, and the Z and S twist yarns do not differ by more than a size of two (e.g. 20/1's and 22/1's). For the three color construction, each color is preferably in the amount of at least about 20%, and the amount of Z-twist compared to S-twist yarn is again in the area of between about 30–70% and 70–30%.

It is the primary object of the present invention to provide for an effective fabric or garment, and method of production thereof, which has low torque, good strength, and no discernible course by course slant effect. This and other objects of the invention will become clear from an inspection of the detailed description and from the appended claims.

DETAILED DESCRIPTION OF THE DRAWINGS

Figure 1:
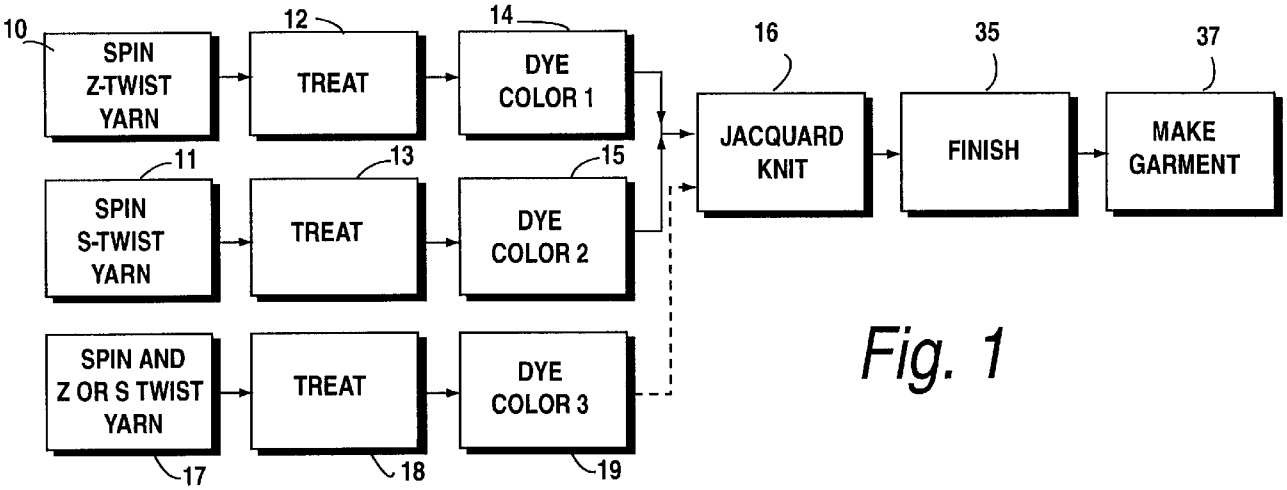
FIG. 1 is a schematic view illustrating exemplary steps for the practice of the exemplary method according to the present invention.

FIG. 1 schematically illustrates exemplary method steps for practicing the method of the present invention to produce a jacquard construction fabric, or garment from the fabric, having little or no torque. The method comprises spinning a first Z-twist yarn, indicated at 10 and spinning a second S-twist, yarn 11. The spinning steps 10, 11 are preferably practiced by conventional ring spinning. The first and second yarns from boxes 10, 11 are optionally conventionally treated as indicated by boxes 12, 13, such as by one or more conventional preparation steps like heat treatment, washing, or the like, and then are dyed using conventional techniques as illustrated at the boxes 14, 15.

The yarn spun at 10 and 11 is at least primarily (more than 50%) cotton yarn, but preferably is substantially 100% cotton yarn (preferably all cotton). The dyeing of the first yarn at box 14 is of a first color, such as red, the dyeing of the second yarn at box 15 is of a second color, such as blue. The colors utilized in steps 14 and 15 may differ greatly, in wave length, feel, and/or intensity, but it is only necessary that they differ enough in one or more of these (or related) qualities so that when a fabric and garment are ultimately produced there is substantially no discernible course by course slant effect in the fabric/garment.

After dyeing at boxes 14, 15 the first and second yarns are used in a conventional circular knitting machine to form a jacquard knit as illustrated schematically at 16 in FIG. 1. While in the preferred construction if there are only two yarns the yarns are provided so that about 50% of one yarn (e.g. 45–55%), and about 50% of the other yarn (e.g. 55–45%) are utilized, the desired effects can be achieved according to the invention even if there is between about 30–70% Z-twist yarn and between about 70–30% S-twist yarn.

Yarn sizes that can be used with the construction of the invention can vary from 8/1's to 40'1's cotton count, preferably 18/1's to 28/1's. Using the same yarn sizes together (S & Z) is desirable, however the yarn size can vary two sizes within a construction (e.g. 20/1's and 22/1's can be used together).

As one modification according to the invention, a third yarn can be spun (e.g. ring spun) as illustrated at 17 in FIG. 1, treated as conventional at 18, and dyed (utilizing conventional techniques) a third color as indicated at 19 in FIG. 1. This third yarn is then used in the jacquard knit at step 16 so that first, second and third yarns are provided in the fabric (depending upon the design possibly in substantially alternate courses). Again, the best results are obtained when approximately 50% of the yarns utilized are Z-twist and about 50% S-twist, but the ratio may vary between about 30–70% and 70–30%.

Figure 2:
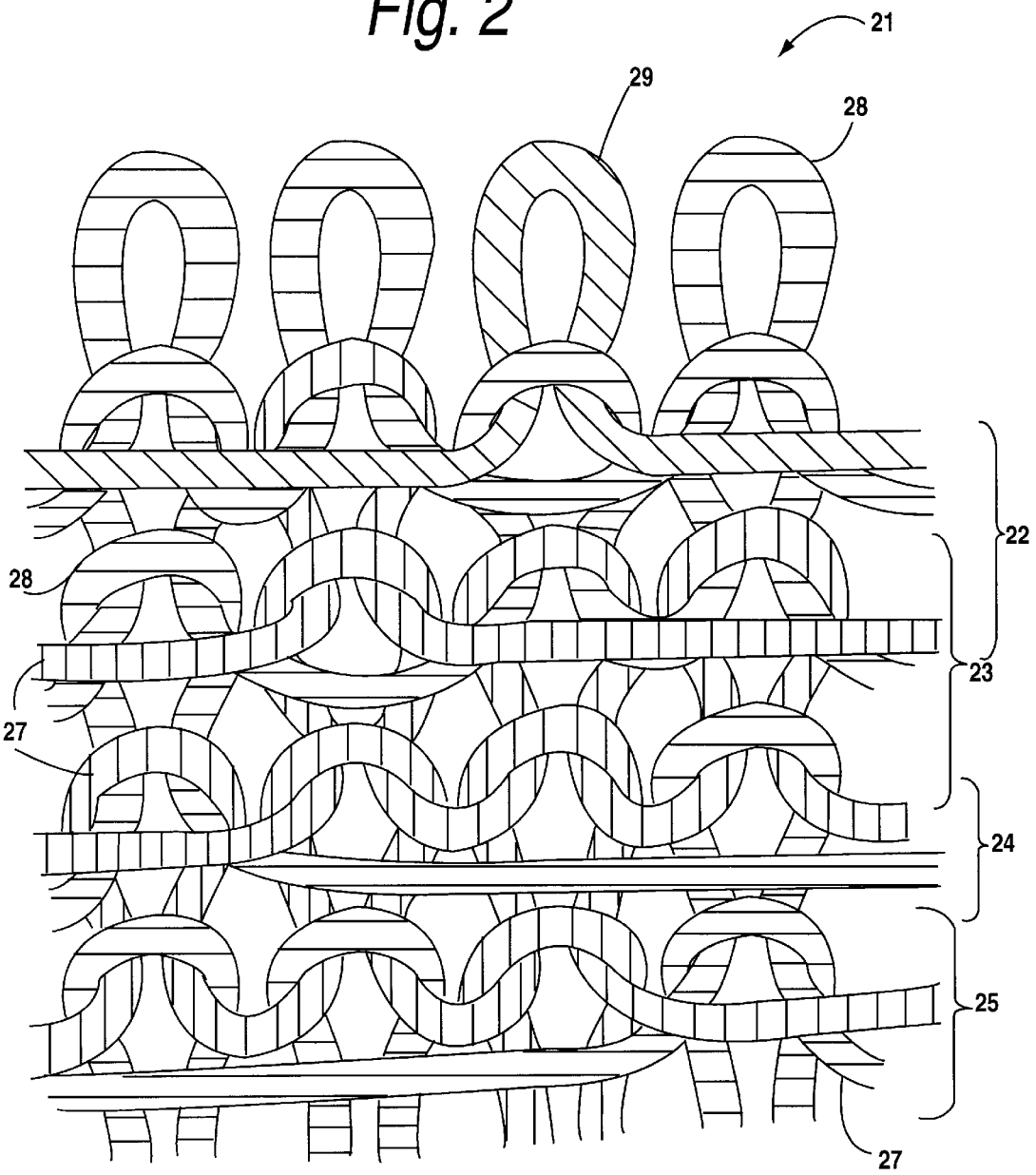
FIG. 2 is a schematic stitch diagram illustrating an example of the fabric according to the invention.

The fabric that is knit at step 16 is shown schematically at 21 in FIG. 2. FIG. 2 is for the embodiment where two different colors are used, and illustrating only several of the courses, 22–25, respectively.

In the FIG. 2 schematic illustration, the first course 22 has a first yarn 27 (that is by step 10), that is substantially 100% cotton ring spun (Z-twist yarn for the first color yarn, shown at the color red in FIG. 2), and a second yarn 28, e.g. the yarn from step 11, preferably 100% cotton ring spun S-twist yarn of a second color (hatched for blue in FIG. 2). The second course 23, third course 24, and subsequent courses 25, will have different stitches and color/twist yarn 27, 28, placements depending upon the details of the jacquard design produced.

Figure 3:
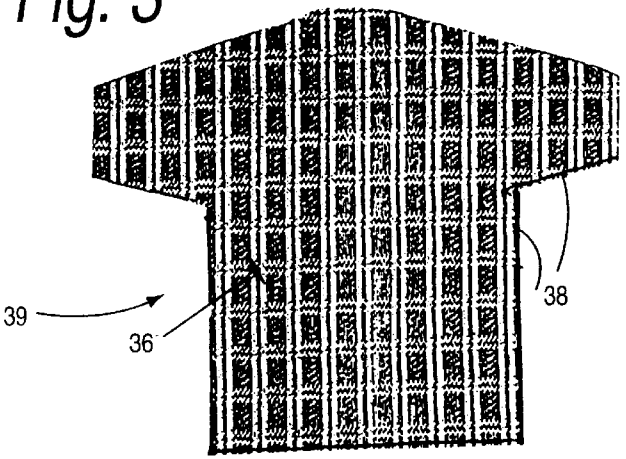
FIG. 3 is a schematic view of a substantially no torque garment produced according to the present invention.

The following are the instructions for the various feed controls for a circular knitting machine, for making a fabric according to the invention, specifically the fabric of FIG. 3. This is a 48 feed pattern. The odd feeds are Z-twist (e.g. red) yarn and the even feeds are S-twist (e.g. blue) yarn. This is a two feed per course pattern; i.e. it takes two feeds for one row of knit stitches. In the diagram, X=Knit Stitch; O=Welt or Miss Stitch; and T=Tuck Stitch.

| | |
|---|---|
| Feed 48 | XOXXXOXXXXXXXXX |
| Feed 47 | OXOOOXOOTOOOTOO |
| Feed 46 | OXXXOXXXXXXXXXX |
| Feed 45 | XOOOXOOTOOOTOOO |
| Feed 44 | XOXXXOXXXXXXXXX |
| Feed 43 | OXOOOXTOOOTOOOT |
| Feed 42 | OXXXOXXXXXXXXXX |
| Feed 41 | XOOOXTOOOTOOOTO |
| Feed 40 | XOXXXOXXXXXXXXX |
| Feed 39 | OXOOOXOOTOOOTOO |
| Feed 38 | OXXXOXXXXXXXXXX |
| Feed 37 | XOOOXOOTOOOTOOO |
| Feed 36 | XOXXXOXXXXXXXXX |
| Feed 35 | OXOOOXTOOOTOOOT |
| Feed 34 | OXXXOXXXXXXXXXX |
| Feed 33 | XOOOXTOOOTOOOTO |
| Feed 32 | XOXXXOXXXXXXXXX |
| Feed 31 | OXOOOXOOTOOOTOO |
| Feed 30 | OXXXOXXXXXXXXXX |
| Feed 29 | XOOOXOOTOOOTOOO |
| Feed 28 | XOXXXOXXXXXXXXX |
| Feed 27 | OXOOOXTOOOTOOOT |
| Feed 26 | OXXXOXXXXXXXXXX |
| Feed 25 | XOOOXTOOOTOOOTO |
| Feed 24 | XOXXXOXXXXXXXXX |
| Feed 23 | OXOOOXOOTOOOTOO |
| Feed 22 | OXXXOXXXXXXXXXX |
| Feed 21 | XOOOXOOTOOOTOOO |
| Feed 20 | XOXXXOXXXXXXXXX |
| Feed 19 | OXOOOXTOOOTOOOT |
| Feed 18 | OXXXOXXXXXXXXXX |
| Feed 17 | XOOOXTOOOTOOOTO |
| Feed 16 | XOXXXOXXXXXXXXX |
| Feed 15 | OXOOOXOOTOOOTOO |
| Feed 14 | OXXXOXXXXXXXXXX |
| Feed 13 | XOOOXOOTOOOTOOO' |
| Feed 12 | TOOXOOOXOXOXO |
| Feed 11 | XXXOXXXOXOXOXOX |
| Feed 10 | OOXOOOXOXOXOXOX |
| Feed 09 | XXOXXXOXOXOXOXO |
| Feed 08 | XOXXXOXXXXXXXXX |
| Feed 07 | OXOOOXOOOTOOOTO |
| Feed 06 | OXXXOXXXXXXXXXX |
| Feed 05 | XOOOXOOOTOOOTOO |
| Feed 04 | TOOXOOOXOXOXOXO |
| Feed 03 | XXXOXXXOXOXOXOX |

-continued

| | |
|---|---|
| Feed 02 | OOXOOOXOXOXOXOX |
| Feed 01 | XXOXXXOXOXOXOXO |

A third yarn 29 produced by the steps 17–19 in FIG. 1, e.g. substantially 100% cotton ring spun yarn dyed a third color, e.g. green, may also be used. The third yarn 29 may be either S or Z-twisted, and alternate times that the third yarn 29 is utilized it may be of an opposite twist, alternating between Z or S-twisted yarn. The yarns need not be in alternate courses, but rather several courses of the same yarn may be provided in a row, as long as the desired results of the invention are achieved.

It should be understood that the fabric constructions of FIGS. 2 and 3 are exemplary only, and any modifications are possible within the scope of the invention. Of course, the colors indicated in FIG. 2 are particularly representative only, and substantially all colors typically used for jacquard construction fabrics may be employed. Also, the colors need not differ from each other as dramatically as illustrated in FIG. 2, that is where the wave lengths are very different (red and blue being vastly differing wave lengths); instead the colors may differ in hue, intensity, gloss, or a wide variety of other values, it being only necessary that the colors in the various courses 22 through 25 are distinct enough so that substantially no discernible course by course slant effect is provided in the fabric.

By practicing the present invention in step 16, the fabric 21 has a torque below 8% and is strong. Preferably it has a torque of less than 5%, and fabrics have been produced according to the invention with very low torque, between about 0–2%.

After the fabric 21 is produced in step 16 the fabric is finished as illustrated schematically at 35 in FIG. 1. While the finishing step 35 is basically conventional, little or no stiffening agent needs to be utilized therein because of the low torque inherent in the fabric 21. Because there is substantially no stiffening agent added in the finishing step 35, the final fabric produced, as illustrated at 21 in FIG. 2, and at 36 in FIG. 3, has a much softer hand than conventional jacquard construction 100% cotton ring spun fabrics that are capable of sometimes having a torque below 8%. Also, where a finishing process 35 is utilized with bow/bias/hook, because the fabric 21 is so straight going to the conventional finishing frame, and the torque does not affect the edge of the fabric for hook after slitting, the finishing process 35 is much simpler.

After finishing at 35 to produce a fabric 36, the method preferably also comprises the step of garment making, as illustrated at 37 in FIG. 1. Garment making is typically at a different location than the fabric production, and is per se conventional, utilizing cutting and then stitching—as illustrated schematically at 38 in FIG. 3—to stitch two or more pieces of the fabric 36 together to produce a garment 39 (see FIG. 3). The garment 39 illustrated in FIG. 3 (schematically illustrated as a T-shirt, but of course virtually any garment where a jacquard construction is typically used can be produced in step 37) has little or no torque, at least less than 8% torque, preferably less than 5% torque, and most preferably between 0–2%. Since the fabric 36 lays flat during garment making in step 37, the garment making process 37 is simplified.

Figure 4:
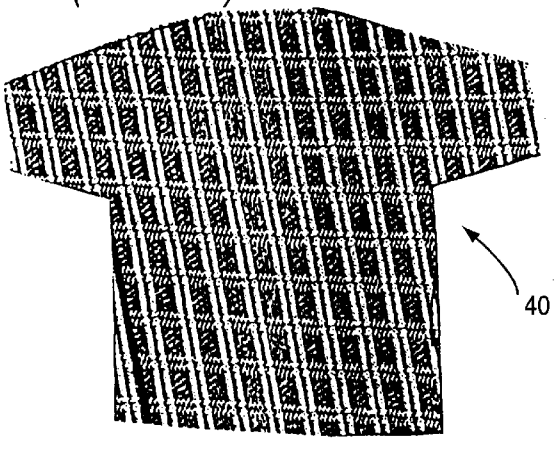
Fig. 4 (Prior Art)
FIG. 4 is a view like that of FIG. 3 for a prior art jacquard construction, having a torque of about 10–12%.

When the garment 39 is washed in use by the consumer, it still lays flat because of its little or no torque construction, the garment 39 schematically illustrated in FIG. 3 intending to illustrate a garment that has been washed. This construction should be compared to that in FIG. 4 which illustrates a garment 40 like the garment 39 only made by prior art techniques, having an unacceptable level of torque, e.g. between 10–12% as schematically illustrated in FIG. 4.

As can be seen schematically in FIG. 3, there is substantially no discernible course by course slant effect in the fabric 36 or garment 39 produced thereby.

It will thus be seen that according to the present invention a simple yet effective method has been provided for producing a garment with a jacquard construction yet having a torque less than 8% with substantially no discernible course by course slant effect, and the garment produced from the fabric. This and other objects of the invention will become clear from an inspection of the detailed description of the invention and from the appended claims.

What is claimed is:

1. A method of making an at least primarily cotton jacquard construction fabric, comprising the steps of:

(a) spinning and Z-twisting a first at least primarily cotton yarn;

(b) spinning and S-twisting a second at least primarily cotton yarn;

(c) dyeing the first yarn a first color;

(d) dyeing the second yarn a second color different than the first color; and (e) knitting a jacquard construction fabric using the first and second yarns in a ratio of about 30–70% Z-twist yarn to about 70–30% S-twist yarn, so that a fabric having a torque below 8%, and substantially no discernible course by course slant effect, is produced.

2. A method as recited in claim 1 comprising the further steps of (f) spinning and either Z or S twisting a third at least primarily cotton yarn, and (g) dyeing the third yarn a third color, different than the first and second colors; and wherein step (e) is practiced by knitting a three color jacquard construction fabric using the first, second, and third yarns in substantially alternating courses.

3. A method as recited in claim 1 wherein steps (a) and (b) are practiced by ring spinning.

4. A method as recited in claim 1 wherein steps (a) and (b) are practiced to produce first and second substantially 100% cotton yarns, having a yarn size for each yarn of between 8/1's to 40/1's cotton, and the sizes of the first and second yarns not differing by more than two sizes.

5. A method as recited in claim 1 comprising the further steps of (f) finishing the fabric, substantially without stiffener, and (g) making the fabric into a garment.

6. A method as recited in claim 1 wherein steps (a)–(e) are practiced to produce a fabric with a torque of less than 5%, and wherein the fabric has about 50% first yarn and about 50% second yarn.

7. A method as recited in claim 4 wherein steps (a)–(e) are practiced to produce a fabric with a torque between about 0–2%, and wherein the fabric has ab out 50% first yarn and about 50% second yarn.

8. A method as recited in claim 1 wherein steps (a)–(e) are practiced to produce a fabric with a torque between about 0–2%, and wherein the fabric has about 50% first yarn and about 50% second yarn.

9. A method as recited in claim 2 wherein step (f) is practiced to produce a substantially 100% cotton ring spun yarn; and wherein about 50% of the yarns are S-twist and about 50% are Z-twist.

10. A method as recited in claim 1 wherein steps (a) and (b) are practiced by ring spinning and to produce first and second substantially 100% cotton yarns; and wherein steps (a)–(e) are practiced to produce a fabric with a torque of less than 5%; and comprising the further steps of finishing the fabric, and (g) making the fabric into a garment.

11. A fabric comprising:

first and second yarns providing a jacquard knit construction fabric, having a torque of less than 8% and substantially no discernible course by course slant effect;

said first yarn comprising a first color Z-twisted at least primarily cotton yarn;

said second yarn comprising a second color, different than said first yarn, S-twisted at least primarily cotton yarn; and said fabric having a ratio of about 30–70% Z-twist yarn to about 70–30% S-twist arn.

12. A fabric as recited in claim 11 having a torque of less than 5%.

13. A fabric as recited in claim 11 further comprising a third at least primarily cotton either S or Z-twisted yarn having a third color different from said first and second colors, said fabric jacquard knit construction comprising said first, second and third yarns.

14. A fabric as recited in claim 11 where in said first and second yarns are ring spun substantially 100% cotton yarns, having a yarn size for each yarn of between 8/1's to 40/1's cotton, and the sizes of the first and second yarns not differing by more than two sizes.

15. A fabric as recited in claim 14 wherein said fabric has a torque of between about 0–2%, and wherein the fabric has about 50% first yarn and about 50% second yarn.

16. A fabric as recited in claim 14 in combination with stitching forming said fabric into a finished garment.

17. A fabric as recited in claim 16 wherein said garment has a torque of between about 0–2%, and wherein the fabric has about 50% first yarn and about 50% second yarn.

18. A fabric as recited in claim 13 wherein said first, second, and third yarns are ring spun substantially 100% cotton yarns and wherein said fabric has a torque of less than 5%.

19. A fabric comprising:

first, second and third yarns in a jacquard knit construction fabric, said fabric having a torque of less than 5%;

said first yarn comprising a Z-twisted substantially 100% cotton ring spun yarn; and said second and third yarns each comprising an S-twisted substantially 100% cotton ring spun yarn, or a combination of S- and Z-twisted yarns, and wherein said fabric has substantially no discernible course by course slant effect.

20. A fabric as recited in claim 19 in combination with stitching to form a finished garment, and wherein each of said yarns has a size of between 18/1's to 28/1's cotton, and the sizes of the first, second, and third yarns not differing by more than two sizes.

* * * * *